United States Patent [19]

Schoendorfer et al.

[11] 4,417,884

[45] Nov. 29, 1983

[54] CENTRIFUGE TIMER CLAMP

[75] Inventors: Donald W. Schoendorfer, Brookline; Allen Latham, Jr., Jamaica Plain, both of Mass.

[73] Assignee: Haemonetics Corporation, Braintree, Mass.

[21] Appl. No.: 281,650

[22] Filed: Jul. 9, 1981

[51] Int. Cl.[3] ..... B04B 11/00

[52] U.S. Cl. ..... 494/4; 137/53; 137/54; 251/9; 494/9; 494/11; 494/27; 494/85

[58] Field of Search ..... 494/1, 2, 3, 4, 5, 6, 494/10, 27, 85, 9, 11, 45; 604/6, 131; 137/53, 54, 57; 251/9; 210/104, 112, 113, 115, 119

[56] References Cited

U.S. PATENT DOCUMENTS

| | | | |
|---|---|---|---|
| 3,421,414 | 1/1969 | Peale | 137/53 |
| 3,674,197 | 7/1972 | Mitchell et al. | 233/14 |
| 3,679,128 | 7/1972 | Unger et al. | 233/20 |
| 3,907,504 | 9/1975 | Hammond et al. | 23/258.5 |
| 3,987,961 | 10/1976 | Sinn et al. | 233/27 |
| 4,061,142 | 12/1977 | Tuttle | 251/9 |
| 4,146,172 | 3/1979 | Cullis et al. | 233/26 |

*Primary Examiner*—Robert W. Jenkins

*Attorney, Agent, or Firm*—Hamilton, Brook, Smith & Reynolds

[57] ABSTRACT

A timing and control mechanism for a centrifuge comprising a piston to which is attached a cam having cam surfaces which interact with flexible tubing to control the rate of flow through the tubing. The velocity of the piston in the centrifugal force field is determined by the resistance to flow of fluid which the piston displaces. The movement of the cam is therefore a measure of the speed and duration of the centrifugal force.

16 Claims, 10 Drawing Figures

CENTRIFUGE TIMER CLAMP

DESCRIPTION

TECHNICAL FIELD

The technical field is blood processing centrifuges.

BACKGROUND ART

In the treatment or processing of biological liquid such as blood; equipment has been provided whereby red blood cells, white cells, plasma, and platelet components are separated from whole blood in a centrifuge. In the course of processing blood within the centrifuge, portions of the separated blood components are either retained for storage or transferred to another patient or are returned to the donor. The blood processing may take place intervivos as is shown in U.S. Pat. No. 4,146,172 dated Mar. 27, 1979 entitled Centrifugal Liquid Processing System to Cullis et al.

In other centrifuge blood processing systems the process is not completely intervivos and the centrifuge may be stopped as the blood is processed into its constituent component elements and then some or all of the separated elements are stored or returned to the donor as the case may be. Such a system is described in U.S. patent application Ser. No. 005,126 filed Jan. 22, 1979, now U.S. Pat. No. 4,303,193, entitled Apparatus for Separating Blood into Components Thereof to Allen Latham, Jr.

U.S. Pat. No. 3,679,128 entitled Centrifuge issued July 25, 1972 to Unger et al also shows a centrifuge for processing blood in which an electromagnetic valve operates to control the flow of processed blood from one container to another container during the centrifuge process—that is to say, while the centrifuge rotor is spinning.

In each of the above-described processes it is desirable to provide a simple and reliable mechanism to control the timing of the separation procedures. Preferably such a timing mechanism should operate in a manner directly proportional to the magnitude of the centrifugal force field since it is this quantity that directly influences the blood separation process.

Present controlling means usually operate on the basis of an electronic or electromagnetic switch which is coupled into the centrifuge through slip rings or other means and is remotely operated based on some predetermined time or sensor setting. For example, see the valve 22 in U.S. Pat. No. 3,679,128 or the hydraulically actuated clamp 142 in patent application Ser. No. 005,126 previously referenced.

Such prior art systems suffer from the same drawback; variations in the rotational speed of the rotor are not automatically compensated for and must be compensated for by some other means. In addition, prior art systems require means to transmit a control signal to the rotor through some form of slip seal. These seals are expensive and tend to have short life expectancies in application.

INVENTION DISCLOSURE

In the apparatus of the present invention a hydraulically actuated timer clamp is mounted directly on the rotor of a centrifuge and is thereby subjected to the same centrifugal motion as the processed blood. The hydraulic timer clamp consists of two assemblies, a timer mechanism and a clamp actuator. The timer mechanism consists of a cylinder having first and second volumes separated by a movable piston. The piston contains two fluid passageways for fluid flow between first and second volumes. The first passageway has a needle valve control which is adjusted to control the fluid velocity through this passageway. In practice, this needle valve is adjusted to provide a relatively small cross-sectional area to the passageway; thus producing a relatively high resistance to flow. Alternatively, the variable needle valve passageway may be replaced by a fixed capillary of small internal diameter.

The second passageway in the piston is of relatively large cross-sectional area and thus is relatively low in flow resistance. This passageway is provided with a check valve which will close the passageway when the centrifuge is spinning and thereby prevent flow through the second passageway when the rotor of the centrifuge is spinning.

The piston is arranged so it is able to move radially outward with respect to the axis of rotation of the centrifugal force, or inward by manually re-setting the plunger. The diameter of the capillary or needle valve opening, the viscosity and density of the oil or other fluid in th two volumes, and the mass of the piston determines the distance the piston moves during a given period of time under the influence of the centrifugal force for a given radius of center of gravity of the piston with respect to the center of rotation of the centrifuge rotor. Thus, the movement of the piston directly represents the duration and speed of rotation of the centrifuge.

The second assembly of the hydrauic timer clamp is the clamp actuator consisting of a cam, a cam follower and one or more actuator pins. The cam is coupled to the piston. The cam moves in response to the motion of the piston. A cam follower moves in response to the surface of the cam. The cam follower in turn moves one or more actuator pins which clamp flexible wall tubing through which specific blood components flow. In this manner, motion of the piston in turn results in planned opening or clamping of flexible tube walls which in turn results in planned control of flow through the tubing.

Thus, the hydraulic timer clamp times and controls the blood processing system while the centrifuge is in operation under the direct influence of the centrifugal force and without the necessity for elaborate slip rings or other means for connecting the timing mechanism from the rotor to the external system and without additional compensation for variations in rotor speed.

In other words, the response of the piston is directly proportional to the speed and duration of the centrifugal force and is therefore an accurate measure of the timing of the blood separation process which relies basically on the speed and duration of the centrifugal force for separation.

BEST MODE CONTEMPLATED

Figure 1:
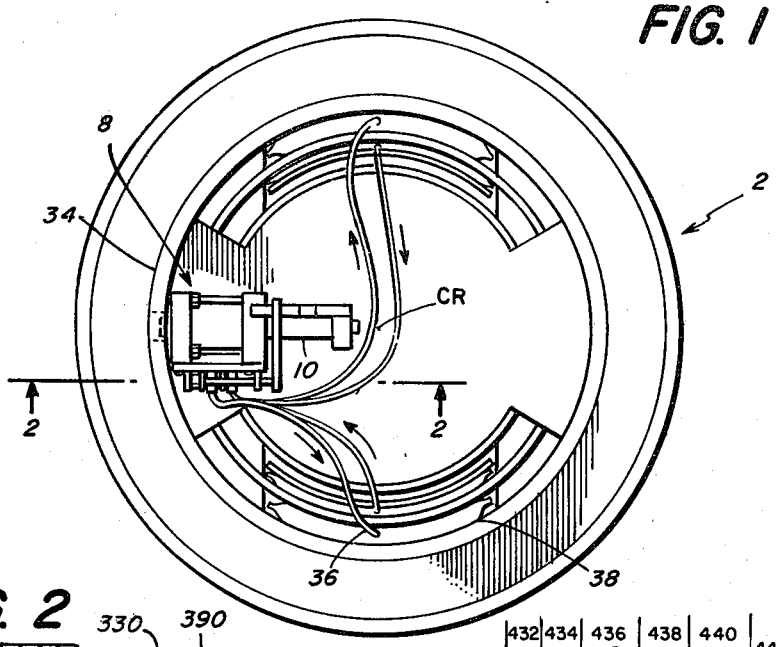
FIG. 1 is a view from above a centrifuge timer clamp in accordance with the invention shown installed in a centrifuge.

Referring to the Figures and particularly to FIG. 1, a hydraulic timer clamp is shon generally at 8 mounted on the side of a rotor cylinder 34 of a centrifuge 2. The centrifuge is capable of rotating at relatively high speeds sufficient to effect the desired processing of blood from or within blood processing chambers such as, for example, the bags 38. The blood processing chamber 38 has connected to it one or more flexible tubes 36 through which blood passes in the centrifuge process. The details of a particular centrifuge process, for which this timer clamp is suitable are shown in patent application U.S. Ser. No. 005,126 previously referenced.

Figure 2:
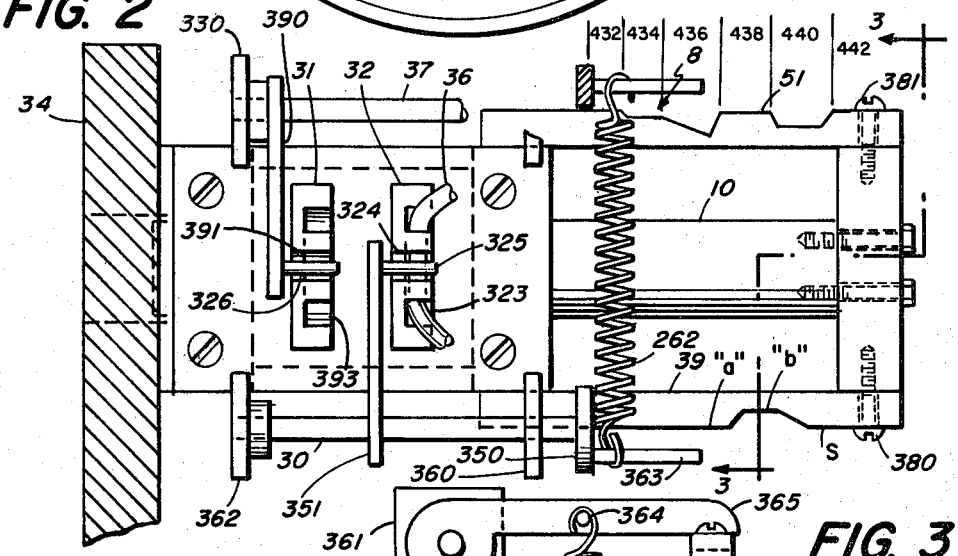
FIG. 2 is a side view of the timer clamp of FIG. 1 taken along lines 2—2 of FIG. 1.
Figure 3:
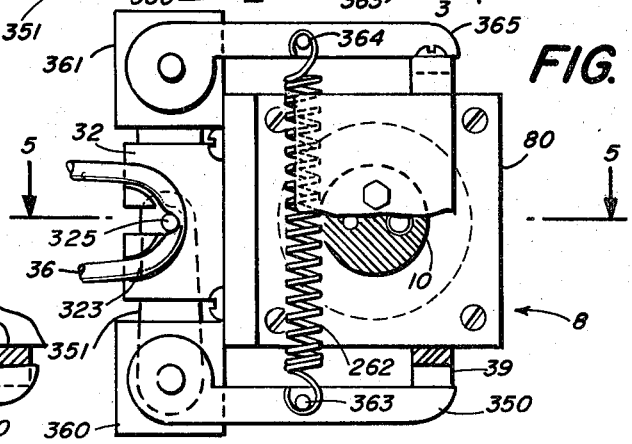
FIG. 3 is an end view along the line 3—3 of FIG. 2 showing the clamp engaged with the blood tubing and stopping flow.
Figure 4:
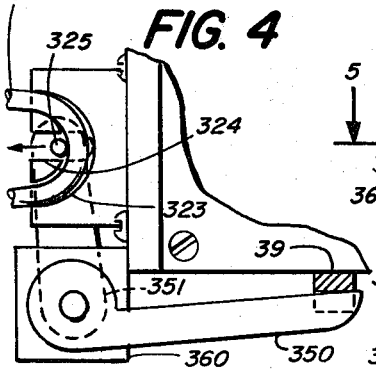
FIG. 4 is a partial end view as in FIG. 3 showing the clamp disengaged from the tubing.

Referring now to FIGS. 2-4, there is shown the exterior of the hydraulic timer clamp 8 of this invention consisting of a timer mechanism 80 (described in connection with FIGS. 5 and 6) and a clamp actuator described in detail in connection with FIGS. 2-4. The clamp actuator consists of one or more tube clamping mechanisms which are actuated by the piston of the hydraulic timer 80. The control cycle for each such clamping mechanism is established by the rise and fall contour of a cam such as 39 or 51 shown in FIG. 2. Each such cam is secured to the pisto 10 of timer mechanism 80 so that its motion is timed by the motion of piston 10.

The rise and fall of the cam is transmitted to tube clamp pin 325 and 326 by respective follower arms 350 and 365. The follower arms are attached to respective pivot shafts 30 and 37 which pivot in bearings. Pivot shaft 30 attached to follower arm 350 pivots on bearings 360 and 362 and couples the follower arm motion through arm 351 to tube clamp pin 325. A spring 262 serves to hold follower arm 350 against the profile of cam 39.

Correspondingly, follower arm 365 is attached to pivot shaft 37 which pivots on bearings 361 and 330. The pivot shaft is also attached to arm 90 on the end of which is a tube clamp pin 326.

Pins 325 and 326 ride within slots 324 and 391 in respective tube guides 32 and 31 in response to the rise and fall of the cam contour as just described. Arcuate slots 323 and 393 are provided in each tube guide 32 and 31 and the flexible tubes such as 36 through which blood components pass in the centrifuge process are retained in these arcuate slots.

Slot 324 extends into or intersects with arcuate slot 323 thus pin 325 may be moved up or down to open or pinch clamp flexible tube 36.

To recapitulate, as cam 39, which is secured to piston 10, moves away from the center of rotation (CR) under the influence of the centrifugal force created by rotation of rotor 34; follower arm 350 under the influence of spring 262 will follow the contours of surface "S" of cam 39. The rotational motion of arm 350, as it follows the contours of surface "S", is converted to a corresponding motion of pin 326 within slot 324 by the rotation of shaft 30 intermediate arms 350 and 351. Thus, pin 326 moves in or out of slot 324, compressing or opening tubing 36 in response to the motion of cam 39 which is controlled by the movement of plunger 10. The relative motion can be seen by comparing FIGS. 3 and 4. In FIG. 3, follower cam 350 is riding on level "a" of surface "S" and pin 326 compresses tube 36 and so prevents flow. In FIG. 4 follower arm 350 is at level "b" and pin 326 has moved away from tube 36 permitting flow.

The operation of follower arm 365 with respect to cam 51 and pin 326 is identical to that of follower arm 350, accordingly the above description will suffice for both.

Figure 5:
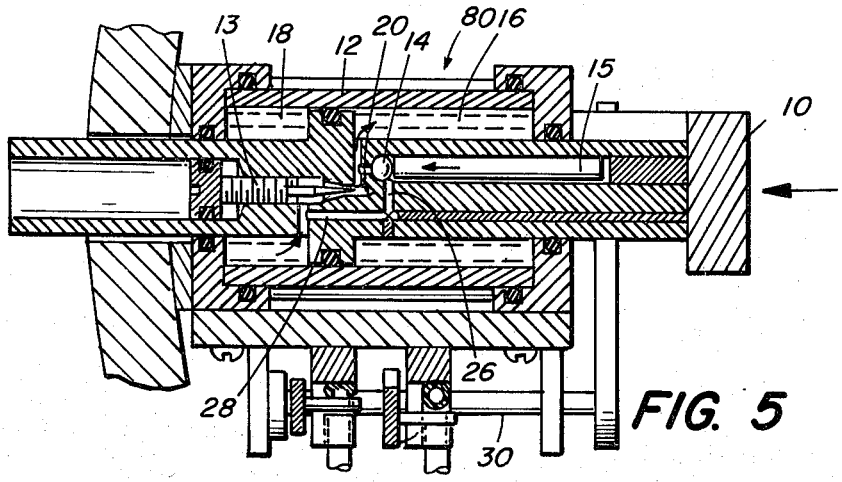
FIG. 5 is a sectional view along the lines 5—5 of FIG. 3 showing the operational stroke of the plunger as it moves under centrifugal force.
Figure 6:
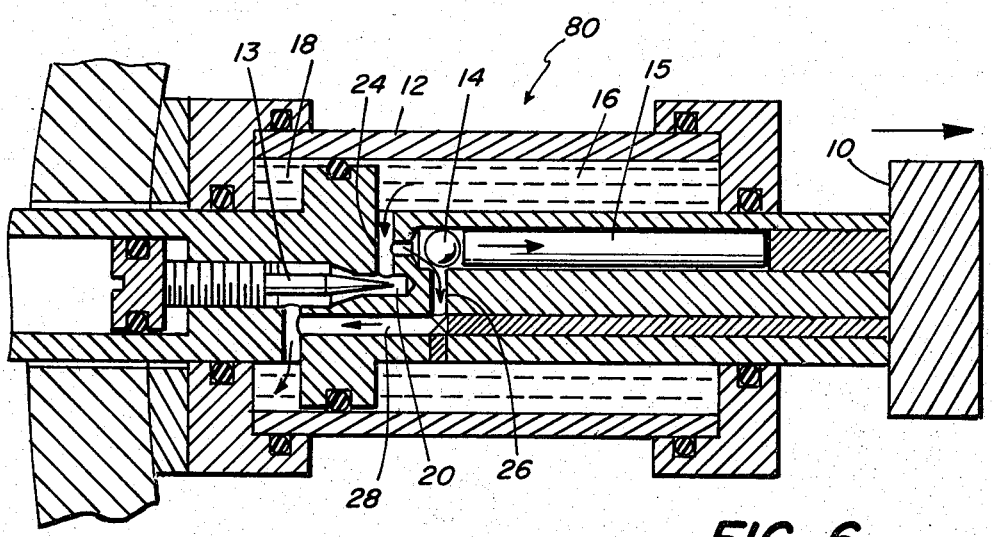
FIG. 6 is a sectional view along the lines 5—5 of FIG. 3 during the re-set stroke of the plunger.

Referring now to FIGS. 5 and 6, the timer mechanism shown generally at 80 may be described. This mechanism comprises a cylinder 12 containing a piston 10 and first and second fluid volumes 16 and 18, respectively. Preferably the fluid is an oil such as silicone oil having relative constant viscosity over a wide temperature range. A second volume of identical fluid 18 is also contained in the cylinder. The cylinder with fluid is disposed about piston 10 in a fluid-tight relationship. Piston 10 is allowed to move in either direction longitudinally within the cylinder 12. Piston 10 extends beyond the cylinder housing at both ends and it is important that the cross-sectional area of the piston is equal on both sides.

A narrow fluid path 20 is provided between the first volume of fluid and the second volume of fluid. The opening in this path and thus the velocity of flow throughout is controlled by the setting of needle valve 13. Alternatively, a fixed capillary may be provided at this point.

By use of ball 14 as a check valve; flow can occur in channel 26 only in the direction indicated by the arrow in channel 26 thus allowing re-setting of the piston to its starting position more easily than by forcing the oil through the small pathway controlled by the needle valve.

In the active stroke of the piston, the piston moves longitudinally (from right to left as indicated by the arrow in FIG. 5) along the axis of cylinder 12 as will occur when the centrifuge rotates about the center of rotation (CR) (shown in FIG. 1). The piston generates considerable force trying to fly out from the center of rotation; but it is constrained by the oil in the two volumes, and in particular the oil in volume 18 of the cylinder. During this active stroke the check valve 14 is closed thus preventing flow of oil through path 26. The check valve is held closed both by the pressure differential across it and the weight of the metal rod 15 that is resting on it, as well as on its own weight. It should be noted that weight 15 may, or may not, be required to maintain ball valve closed in the active stroke. Thus, the only way the oil can move out of volume 18 is through path 20.

As the piston 10 moves farther and farther away from the center of rotation there is a higher centrifugal force acting on it. Thus, the rate of movement of the piston away from the center of rotation is not at a fixed rate. However, by appropriate shaping of the cam surfaces of the cams 39 and 51, the non-linear movement of the plunger can be compensated for.

After the centrifuge has come to rest, the reset stroke of the piston can be accomplished by manually pulling the piston towards the center of rotation. That is in the left to right direction as shown by the arrow in FIG. 6. When the rotor 34 is stopped, ball valve 14 may be unseated, since centrifugal force is no longer holding the ball against its seat. Thus, the flow of oil may be reversed as shown in FIG. 6 and oil may flow from the inner or second volume of oil 16 through conduit 24 and into conduit 26, through conduit 28 and into the outer volume of oil 18.

Referring back to FIG. 2, some further details of the invention may now be described. Cams 39 and 51 may be removably mounted on one end of the plunger 10 by means of set screws 380 and 381 respectively. The cam surfaces of the control keys are provided with notches and slots which will either open or clamp off the flexible tubing 36, thus controlling the flow of blood components. Cam 51 of FIG. 2 is provided, for illustrative purposes, with six regions on the cam surface. When region 432 is adjacent to the follower arm 500 the flow through flexible tubing (not shown) is blocked by pin 326 for a period of time proportional to the length of region 432 on cam 51. This would correspond to the time when the centrifuge is initially spinning at, for example, 2,000 RPM for initial separation of blood. Next, region 434 would allow a low rate of flow through the tubing, then region 436 would gradually increase the flow to a maximum. Region 438 would then clamp off the tube completely for a period of time proportional to the length of region 438. This could be for a period when a higher speed spin was to take place, say at 3,000 RPM. Next, as the cam follower was engaged with region 440, pin 326 would move away from the flexible tube (not shown) to allow flow again and finally region 442 would clamp off the tube for deceleration.

Other embodiments may occur to those skilled in the art. For example, a cam having two opposite cam surfaces could be used to control two follower arms, one positioned on either side of the cam. This would be useful in controlling a two bag plasmapheresis procedure.

Figure 7:
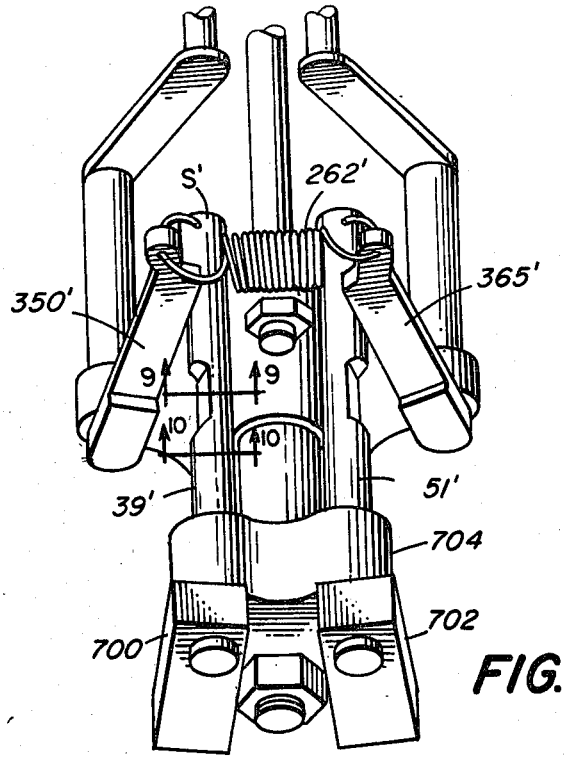
FIG. 7 is a perspective view of an alternate embodiment of the clamp portion of the invention showing the cams in the operative position.
Figure 8:
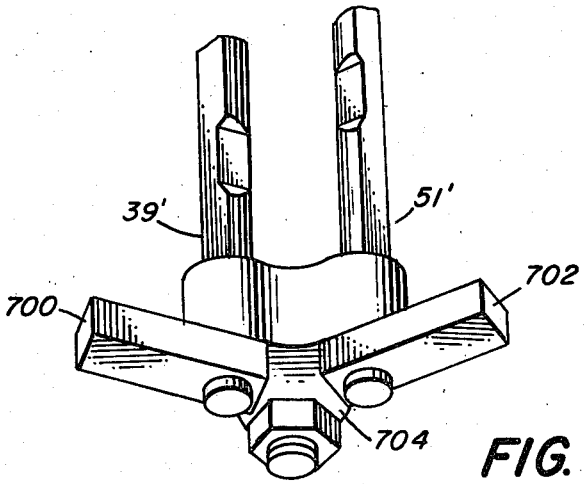
FIG. 8 is a perspective view as in FIG. 7 showing the cams in the re-set position.

FIGS. 7 and 8 show an embodiment of the cam and follower arm structure of the invention wherein the cams are rotatably mounted so that the slotted surfaces of the cam can be readily disengaged from the cam follower level arms permitting the plunger to be moved in or out more readily. It is advantageous to have a cam which may be rotated rather than unfastened. Such a feature would greatly facilitate and speed up resetting of the plunger and placement and removal of the tubing in or from the arcuate slots in the tubes guides 31 and 32. In FIGS. 7 and 8 parts similar to those previously described are correspondingly numbered and primed.

Thus, a pair of lever arms 350' and 365' are held by spring 262' in resilient contact against cams 39' and 51'. Cam surface S' contacts the edge of the cam follower lever arm when handles 700 and 702 are in the positions shown in FIG. 7.

Figure 9:
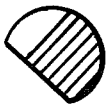
FIG. 9 is a cross-sectional view along the lines 9—9 of FIG. 8.
Figure 10:
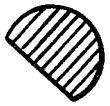
FIG. 10 is a cross-sectional view along the lines 10—10 of FIG. 8.

The cams 39' and 51' in FIGS. 7 and 8 are generally rod-shaped and are rotatably mounted on end piece 704. Cross-sectional views of a typical cam 39' at various locations along cam 39' are shown in FIGS. 9 and 10. Handles 700 and 702 are attached to one end of each rod-shaped cam. Thus, when it is desired to release the cam follower arms 350' or 365' from engagement in a slot in the cam surface S' it is only required to rotate the handles into the positions shown in FIG. 8.

While a particular embodiment of the invention has been shown and described above, it will be obvious to those skilled in the art that changes and modifications may be made without departing from the invention in its broader aspects and therefore the aim in the appended claims is to cover all such changes and modifications as fall within the true spirit and scope of the invention.

We claim:

1. Centrifuge apparatus comprising:

a. a first means for containing first and second volumes of fluid;

b. a fluid path intermediate said first and second volumes for providing fluid communications therebetween;

c. a piston disposed within said first means and capable of bidirectional movement therein;

d. valve means for controlling the velocity of the fluid flow between said first and second volumes; and e. cam means coupled to said piston having at least one actuating surface which moves in proportion to the movement of said piston in response to centrifugal force.

2. The apparatus of claim 1 having check valve means for varying the direction of fluid flow through said fluid path.

3. The apparatus of claim 1 in which the fluid in said first and second volumes is a viscous oil.

4. The apparatus of claim 3 in which the viscosity of the fluid is substantially constant over a wide temperature range.

5. The apparatus of claim 1 in which the actuating surface of said cam means is adapted to control the flow of a body fluid being processed within said centrifuge.

6. The apparatus of claim 1 in which the cam means comprises:

a pair of cams attached to said piston;

a pair of cam follower arms each resiliently held against the cam surface of a respective cam by means of a spring suspended between said arms;

a pair of rotatable actuator pins each coupled to a respective one of said arms, said pins being located in a slot in a guide means opposite a blood processing conduit.

7. Apparatus for processing fluid comprising in combination:

a. a centrifuge having a rotor capable of rotating at relatively high speeds sufficient to effect the desired processing of said fluid;

b. a fluid container mounted on said rotor;

c. conduit means for introducing or removing fluid into or out of said container; and d. timing means, responsive to the amount of centrifugal force and its duration as caused by said high speed rotation, for controlling the flow of fluid through said conduit means.

8. The apparatus of claim 7 in which the fluid being processed is blood.

9. The apparatus of claim 7 in which the timing means comprises a cylinder containing first and second volumes of fluid with a fluid path intermediate said first and second volumes for providing fluid communication therebetween, a piston disposed within said cylinder, valve means for controlling the flow of fluid through said fluid path, and cam means coupled to said piston, said cam means having at least one actuating surface which engages with the conduit means and controls the rate of flow through said conduit means in response to the motion of said piston.

10. The apparatus of claim 7 in which the timing means comprises:

e. a piston adapted to move radially outward from the center of rotation of said rotor in response to said centrifugal force;

f. a cam mounted on said piston;

g. a cam follower arm which rotates in response to the movement of said cam against said arm;

h. an actuator pin coupled to said arm and rotatable in unison with said arm;

i. guide means having an arcuate slot for retaining said conduit means and a straight slot within which said actuator pin is engaged such that said pin may compress or release said conduit means depending on the contour of said cam as said cam moves in relation to said cam follower arm.

11. An apparatus of claim 10 in which the cam consists of a shaped member which is rotatably mounted opposite said cam follower.

12. A centrifuge timer comprising:

a. a cylinder having first and second volumes separated by a piston;

b. first and second fluid passageways in said piston each providing fluid flow between said first and second volumes;

c. the first passageway having a relatively small cross-sectional area to present a relatively high resistance to flow;

d. the second passageway having a relatively large cross-sectional area to present a relatively low resistance to flow;

e. a check valve in said second passageway which closes said second passageway when subjected to predetermined centrifugal force.

13. The apparatus of claim 12 in which the piston extends through said cylinder at both ends thereof and is of a substantially equal cross-sectional area on each side of said volumes.

14. The apparatus of claim 12 in whih the piston moves in a first direction in response to the magnitude and duration of centrifugal force while said second passageway is closed by said check valve and is manually moved in the opposite direction to re-set the timer when the centrifuge has stopped and the second passageway is opened by said check valve.

15. The apparatus of claim 12 in which the cross-sectional area of the first passageway is controlled by a needle valve.

16. The apparatus of claim 12 in which the check valve is a ball valve.

* * * * *